US008416155B2

(12) United States Patent
Kaminaka et al.

(10) Patent No.: US 8,416,155 B2
(45) Date of Patent: Apr. 9, 2013

(54) PLASMA DISPLAY DEVICE AND PLASMA DISPLAY PANEL DRIVE METHOD

(75) Inventors: Tetsuya Kaminaka, Miyazaki (JP); Takashi Shiizaki, Miyazaki (JP); Takashi Sasaki, Miyazaki (JP); Hirohito Kuriyama, Miyazaki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 12/282,055

(22) PCT Filed: May 30, 2006

(86) PCT No.: PCT/JP2006/310779

§ 371 (c)(1), (2), (4) Date: Oct. 23, 2008

(87) PCT Pub. No.: WO2007/138680

PCT Pub. Date: Dec. 6, 2007

(65) Prior Publication Data

US 2009/0153535 A1 Jun. 18, 2009

(51) Int. Cl.
*G09G 3/28* (2006.01)

(52) U.S. Cl. ..... 345/60; 345/63; 345/66; 345/67; 345/205; 315/169.1

(58) Field of Classification Search ..... 345/60, 345/63, 204, 205; 315/169.1, 169.4
See application file for complete search history.

(56) References Cited

U.S. PATENT DOCUMENTS

| | | | | |
|---|---|---|---|---|
| 6,456,263 | B1 * | 9/2002 | Hashimoto et al. | 345/60 |
| 7,545,345 | B2 * | 6/2009 | Kim et al. | 345/60 |
| 2003/0001804 | A1 | 1/2003 | Naganuma | |
| 2003/0107532 | A1 * | 6/2003 | Choi | 345/60 |
| 2004/0085226 | A1 | 5/2004 | Lee | |
| 2004/0085262 | A1 * | 5/2004 | Lee | 345/41 |
| 2004/0246206 | A1 | 12/2004 | Choi | |
| 2005/0035931 | A1 * | 2/2005 | Yoo et al. | 345/63 |
| 2005/0083259 | A1 | 4/2005 | Kim et al. | |
| 2005/0110709 | A1 * | 5/2005 | Lee | 345/60 |

FOREIGN PATENT DOCUMENTS

| | | |
|---|---|---|
| JP | 02-150890 | 6/1990 |
| JP | 2002-366084 | 12/2002 |
| JP | 2003-015590 | 1/2003 |
| JP | 2003-337567 | 11/2003 |
| JP | 2004-062207 | 2/2004 |
| JP | 2004-361964 | 12/2004 |
| JP | 2005-122152 | 5/2005 |
| JP | 2005-234372 | 9/2005 |
| JP | 2006-091437 | 4/2006 |

* cited by examiner

*Primary Examiner* — Lun-Yi Lao
*Assistant Examiner* — Shaheda Abdin
(74) *Attorney, Agent, or Firm* — McDermott Will & Emery LLP

(57) ABSTRACT

Provided is a technique of a PDP device capable of preventing error display arising from changes in discharge characteristics in a reset period particularly due to a long-period operation. In the PDP device, a slope of a slope waveform in the reset period is changed corresponding to operation time of the PDP device. And, the slope waveform is made to have a configuration having a stepwise plurality of slopes in a predetermined reset period. For example, when the operation time becomes long, rising and falling slope waveforms of a reset waveform are configured by two steps, and a first slope thereof is made steeper than a slope before the change, and a second slope is made gentle than the slope before the change. When the operation become longer, the first slope is made further steeper and the subsequent second slope is made further gentler.

11 Claims, 14 Drawing Sheets trn1
trn2
trn3

Vy
521
52
s2
s21
522
s22
811 t0
SW8
ON
OFF
812
813 t1
SW9
ON
OFF
SW10
ON
OFF

PLASMA DISPLAY DEVICE AND PLASMA DISPLAY PANEL DRIVE METHOD

RELATED APPLICATIONS

This application is the U.S. National Phase under 35 U.S.C. §371 of International Application No. PCT/JP2006/310779, filed on May 30, 2006, the disclosure of which Application is incorporated by reference herein.

TECHNICAL FIELD

The present invention relates to a technique for a method of driving a plasma display panel (PDP) and a display device thereof (plasma display device: PDP device), and more particularly, the present invention relates to an operation in a reset period for drive control of subfields.

BACKGROUND ART

Currently, PDP device is in practical use as a flat display being high-luminance, thin, and capable of large-screen display, and its overall operation properties have been improved along with improving display quality. PDP is a display device which performs display using discharges, and generally configured by several hundreds of thousands to several millions of pixels. Generally, in display of an AC-type PDP device, each field that becomes a screen is configured by a plurality of subfields having different luminance weightings. Each subfield is configured by, for example, a reset period, an address period, and a sustain period.

Reset period is a period for generating discharges at all cells and adjusting the amount of charges in the cell to smoothly perform a discharge in a subsequent address period. Address period is a period for performing a discharge (address discharge) for selecting a target On cell in a display area by applying a select pulse to a scan electrode and an address electrode and generating charges. Note that, it is not limited to the method of generating discharges at target On cells (write address method), and there is also a method of reducing charges at cells by generating discharges at target Off cells (erase address method). Subsequent sustain period is a period for performing display by actually lighting (emission), in which repetitive discharges (sustain discharges) are performed by alternately applying pulses across a scan electrode (Y) and a sustain electrode (X) (Y-X) at the cells selected and discharged in the address period just before the sustain period. Especially, the reset period has a role to generate continuous minute discharges to lead to a next address period and align discharge voltages in the address period by adjusting charges in the cells.

To form charges in a reset period, conventionally, there have been applied a waveform whose voltage is gradually raised (rising reset waveform), and subsequently, a waveform whose voltage is gradually fallen (falling reset waveform) as waveforms of the reset period (reset waveform). Such reset waveforms can perform finer control as the slope of the waveforms is smaller (gentler), thereby achieving stable discharge and charge generation. And, as an application of the reset waveforms, the rising and falling waveforms have been made to have stepwise slopes, where a first slope is steep and a second slope is gentle, so that the smaller the slope of the second slope is, the finer the control is. Such a technique is described in Japanese Patent Application Laid-Open Publication No. 2004-62207 (Patent Document 1).

And, as a method of generating a slope waveform, there is a method to apply voltage intermittently while changing voltage gradually to a predetermined voltage. Such a technique is described in Japanese Patent Application Laid-Open Publication No. 2005-122152 (Patent Document 2).

Patent Document 1: Japanese Patent Application Laid-Open Publication No. 2004-62207

Patent Document 2: Japanese Patent Application Laid-Open Publication No. 2005-122152

DISCLOSURE OF THE INVENTION

The conventional AC-type and color-display PDP device has had a problem that the voltage waveform (slope waveform) having slopes like the reset waveform described above cannot make stable discharges as characteristics of discharge generally changes when performing operations of a PDP device (including PDP) for a long time. This is because the electron emission property of MgO (magnesium oxide) being a protective layer covering a front substrate side of the PDP facing a discharge space is changed (deteriorated) along with the operation of the PDP device.

Details of the problem mentioned above will be explained below. Generally, the protective layer (MgO) mentioned above has less electron emissions, especially, as a long period of time passes in an operation period of a PDP device (PDP), so that discharges become difficult to be generated. The slope waveform in the reset period described above can achieve a continuous weak discharge stably in a PDP device in an initial operation state, but in the case where a long period of time has passed, one time or several times of strong discharges become easy to be generated instead of the continuous weak discharges even when the slope waveform has same slopes. Accordingly, in the case where the operation time of the PDP device is particularly long, performing the continuous weak discharges which is fine control is difficult to make, so that stable discharges cannot be obtained.

In the conventional techniques, changes in characteristics relating to the discharges according to the operation time of a PDP device mentioned above and conditions (states) mentioned above have not been considered, and thus the slopes of a waveform in a reset period has been configured to be constant.

While the reset period has the function described above, it is feared that, in the case where the strong discharges mentioned above are generated in a reset period at a non-selected cell (non-target On cell) due to the problems described above, charges are generated in the cell and discharges are generated in a sustain period even when no select pulse is applied in an address period, that is, it leads to an error display.

The present invention has been made regarding the problems such as those mentioned in the foregoing, and an object thereof is to provide a technique capable of preventing an error display arising from, especially, changes in discharge property in a reset period due to a long-period operation of a PDP device.

The typical ones of the inventions disclosed in this application will be briefly described as follows. To achieve the object mentioned above, the present invention is a technique for a PDP device having a PDP, a driving circuit, and a control circuit, and the invention has technical means described below.

In the PDP device of the present invention, according to operation time and conditions (states), a slope waveform of a reset period is changed and a waveform which makes discharges stable is maintained. More specifically, a slope waveform in a reset period which is required or desired to adjust charges precisely is made to have a configuration of slopes adapted to characteristics (changes thereof) of a protective layer and so forth of the PDP, and the slope is changed to be gentler in accordance with the operation time. In this manner, preferred weak discharges (continuous weak discharges) described above are generated in an operation in a reset period, thereby achieving fine control and preventing error display.

Further, just only gradually changing the slope of the slope waveform in a reset period leads to consuming time by a reset period in the operation time. Accordingly, the slope waveform is changed to have a configuration of waveforms having a plurality of stepwise slopes in, for example, a predetermined reset period according to the operation time.

A configuration of the present PDP device is, for example, as follows. First, the PDP comprises: pluralities of scan electrodes and sustain electrodes extending in a first direction; a first dielectric layer covering the scan electrodes and the sustain electrodes; a protective layer covering the first dielectric layer; a plurality of address electrodes extending in a second direction; a second dielectric layer covering the address electrodes; barrier ribs provided at both sides of the address electrode; and a phosphor provided between the barrier ribs, and cells are configured in matrix corresponding to intersections of the scan electrodes and the sustain electrodes and the address electrodes. The driving circuit applies a voltage waveform for driving to the pluralities of scan electrodes, sustain electrodes, and address electrodes of the PDP. The control circuit controls the voltage waveform. According to the present PDP device and the PDP driving method, drive control of subfields and so forth in a display area of the PDP has: a reset period for generating a discharge at cells to form and adjust charges; an address period for performing a discharge for selecting a target cell to be On; and a sustain period for performing a discharge for display by applying sustain pulses at selected cells.

In the present PDP device, a first voltage waveform having rising and/or falling slope is applied to the electrodes of the PDP, and the slope of the first voltage waveform is changed to be gentler in accordance with conditions and time of an operation of the plasma display device.

Further, in the present PDP device, the first voltage waveform has a configuration having a plurality of stepwise slopes after the change mentioned above at either of rise and fall. Particularly, the first voltage waveform has one type of a first slope before the change, and a waveform after the change has two types of second and third slopes by two steps. And specifically, with respect to the first slope before the change, the second slope which is a first step of the waveform after the change has a larger slope (steeper) than the first slope, and the third slope which is a subsequent second step has a smaller slope (gentler) than the first slope. Further, the steps and degrees of the slopes are enlarged according to steps of change according to the operation time.

Moreover, the present PDP device performs in the reset period an output of the first voltage waveform to both or one of the scan electrode and the sustain electrode of the PDP. And, for example, the control circuit controls sections of a period corresponding to changes in characteristics of the protective layer as conditions and time of the plasma display device, and changes the slope of the first voltage waveform in the reset period in accordance with the section of the period.

The effects obtained by typical aspects of the present invention will be briefly described below. According to the present invention, in a technique for a PDP device, it is possible to prevent an error display arising from changes in discharge characteristics in a reset period due to a long-period operation of a PDP device.

BRIEF DESCRIPTIONS OF THE DRAWINGS

BEST MODE FOR CARRYING OUT THE INVENTION

Hereinafter, embodiments of the present invention will be described in detail with reference to the accompanying drawings. Note that, components having the same function are denoted by the same reference symbols throughout the drawings for describing the embodiment, and the repetitive description thereof will be omitted.

(First Embodiment)

With reference to FIG. 1 to FIG. 12, a first embodiment of the present invention will be described. A feature of the first embodiment is, being particularly shown in FIG. 5 and FIG. 6, to change rising and falling slope waveforms of a reset waveform to a scan electrode of a PDP according to operation time of a PDP device (denoted as T), and respective waveforms after the change are composed by slope waveforms having different two-step slopes. To comprehend the operation time (T), an accumulated counter value of a number of sustain pulses is used.

<PDP Device>

Figure 1:
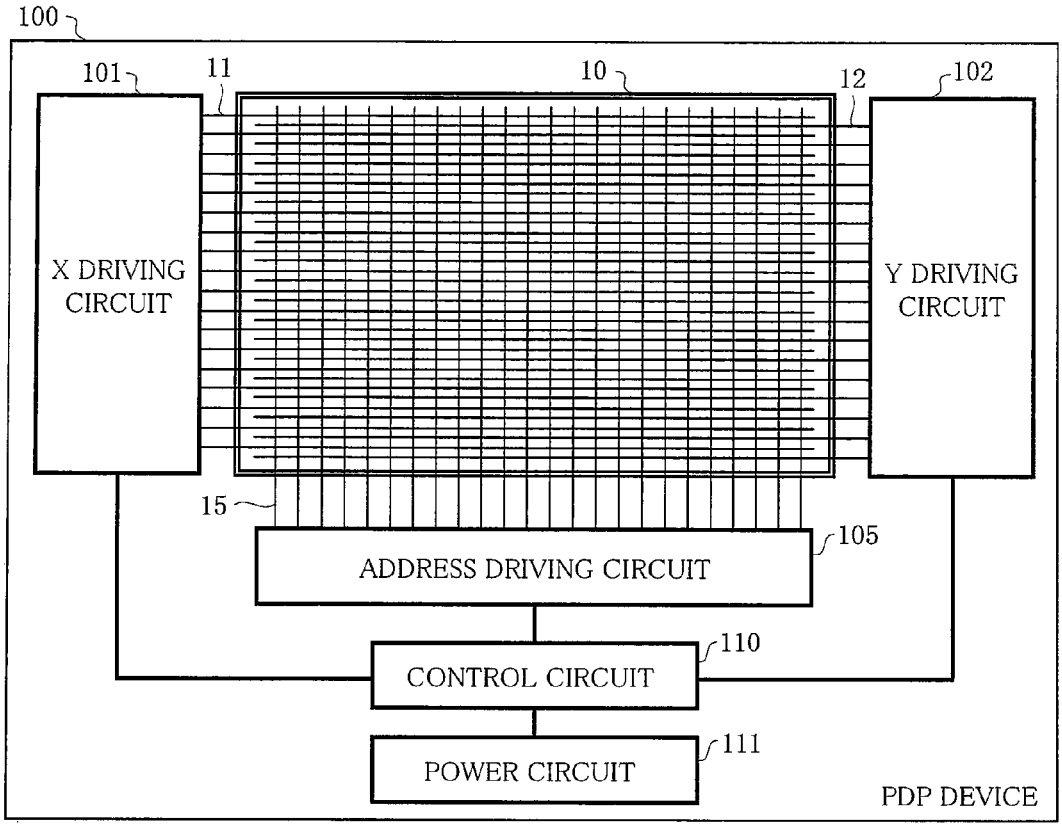
FIG. 1 is a diagram showing an overall configuration of a PDP device according to an embodiment of the present invention.

First, in FIG. 1, an overall configuration of a PDP device (PDP module) 100 of the present embodiment will be described. The present PDP device 100 has, mainly, a configuration having an AC-type PDP 10 and a circuit part for driving and controlling the PDP 10. The PDP module is held to a chassis part not shown having the PDP 10 attached thereto, in which the circuit part is configured by an IC etc., and the PDP 10 and the circuit part are electrically connected. Further, the PDP module is accommodated in an external chassis, so that a PDP apparatus (product set) is composed.

A sustain electrode (X) 11, a scan electrode (Y) 12, and an address electrode (A) 15 of the PDP 10 are respectively connected to corresponding circuits, an X (sustain) driving circuit 101, a Y (scan) driving circuit 102, and an address driving circuit 105, and driven by voltage waveforms of corresponding driving signals. Each driving circuit (101, 102, 105) is connected to a control circuit 110 and controlled by a control signal. The control circuit 110 controls the whole of the PDP device 100, and creates control signals for driving the PDP 10 and display data based on inputted display data (image signal), and outputs the same to each driving circuit. And, a power source circuit 111 supplies power to each circuit such as the control circuit 110.

Note that, the configuration of the circuit part is made different in accordance with the driving method. For example, the address driving circuit 105 is connected and arranged to upper and lower side of the PDP 10 corresponding to the divided address electrodes 15 in a display area of the PDP 10, and there is a configuration where the divided each address electrode 15 group is driven individually from each address driving circuit 105 at upper and lower side thereof.

In the present embodiment, the control circuit 110 has a function of detecting and comprehending the operation conditions and operation time (T) of the PDP device 100 (especially, of the PDP 10), and based on the operation time (T), the control circuit controls the voltage waveforms for driving. Note that, while the function is achieved mainly by the control circuit 110, it can be achieved by other circuits.

<PDP>

Figure 2:
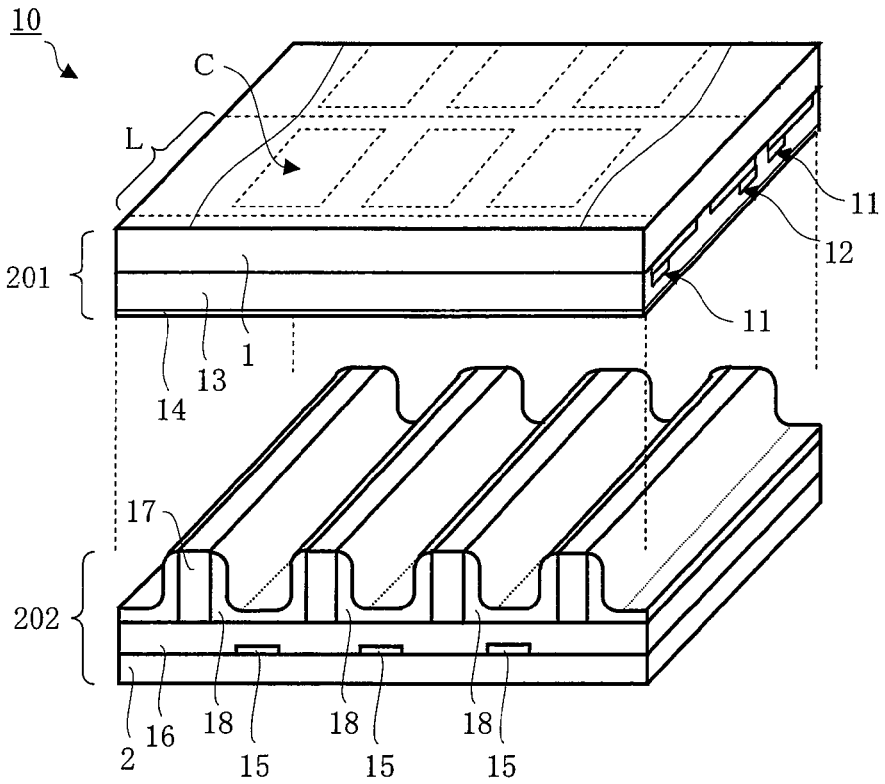
FIG. 2 is an exploded perspective view showing an example of a configuration of a panel (PDP) in the PDP device according to the embodiment of the present invention.

Next, in FIG. 2, an example of a configuration of the PDP 10 (a (X, Y, A) three-electrode, (X, Y) substantial-arrangement, and stripe-rib configuration) will be described. The PDP 10 is configured by assembling a front plate 201 of a front substrate 1 side mainly made of glass and a rear plate 202 of a rear substrate 2 side.

In the front plate 201, the front substrate 1 has arranged thereto the pluralities of sustain electrodes (X) 11 and scan electrodes (Y) 12 for performing repetitive discharges extending in a first direction (horizontal direction) at a predetermined spacing and arranged alternately in a repetitive manner in a second direction (vertical direction). These electrode groups (11, 12) are covered by a first dielectric layer 13, and further a surface of the first dielectric layer 13 facing to a discharge space is covered by a protective layer 14 made of MgO and the like. The protective layer 14 is a material which emits a large number of secondary electrons and has a function of protecting the first dielectric layer 13. The sustain electrode 11 and the scan electrode 12 are configured by, for example, a linear bus electrode made of a metal and a transparent electrode electrically connected to the bus electrode and forming a discharge gap between adjacent electrodes, respectively.

In the rear plate 201, the rear substrate 2 has arranged thereto a plurality of address electrodes 15 extending in parallel in the second direction substantially orthogonal to the sustain electrode 11 and the scan electrode 12. Further, the address electrode 15 group is covered by a second dielectric layer 16. At both sides of the address electrode 15, barrier ribs (vertical ribs) 17 extending in the second direction are arranged so that cells (C) in a column direction of the display area are sectioned. Still further, on an upper surface of the second dielectric layer 16 on the address electrode 15 and sidewalls of the barrier rib 17, phosphors 18 of respective colors which generate visible light of red (R), green (G), and blue (B) by being excited by ultraviolet ray are applied being sectioned per the column.

The front plate 201 at the front substrate 1 side and the rear plate 202 at the rear substrate 2 side are attached so as to contact the protective layer 14 and an upper surface part of the barrier rib 17, and a discharge gas such as Ne—Xe is filled in the discharge space, thereby configuring the PDP 10.

A configuration of each electrode (11, 12) is to form a pair with another type of electrode (12, 11) being adjacent to one side thereof in the second direction so as to form a line (L) by (X, Y), and a discharge is performed in the discharge gap of each cell, that is, a normal configuration by subsequent alignment of the lines of (X, Y). The address electrode 15 further crosses the line (L) so that the cell (C) is configured corresponding to an area sectioned by the barrier ribs 17. A pixel is configured by a set of sells (C) of R, G, B.

The PDP 10 can be made by various configurations other than the example described above in accordance with the driving method, and the features of the present invention and embodiments are applicable to those various configurations. As another configuration example of a PDP, for example, there is a box rib configuration where a horizontal rib which sections the cell in the column direction is provided in addition to the vertical rib. And, there is a configuration where each electrode (11, 12) for display forms a pair with another kind of electrode (12, 11) adjacent to both sides thereof in the second direction so as to form a row, and a discharge can be made at each cell (ALIS configuration). Further, there is a configuration where the sustain electrodes 11 themselves and the scan electrodes 12 themselves are respectively arranged adjacent to themselves at a side of a slit where discharge is not performed, that is, respective electrodes are arranged reverse repetitively such that (X, Y), (Y, X), . . . .

<Field>

Figure 3:
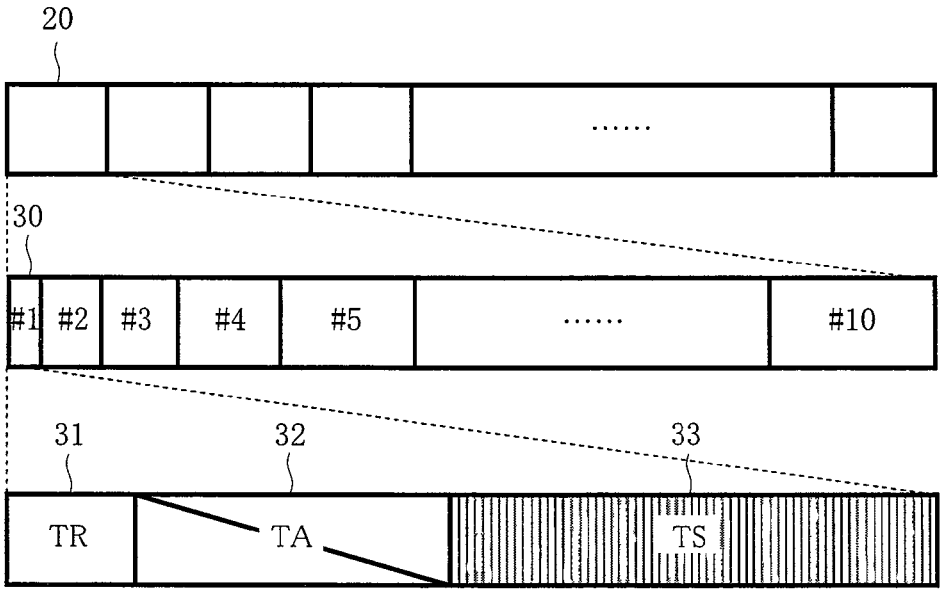
FIG. 3 is a diagram schematically showing a configuration of fields of the PDP device according to the embodiment of the present invention.

Next, in FIG. 3, a configuration and a driving method for image (field) display in the display area of the PDP 10 will be described. One field 20 is displayed at 1/60 second. The one field 20 is configured by a plurality of (in this example, ten of "#1" to "#10") subfields (SF) 30 being divided. Each SF 30 has a reset period (TR) 31, an address period (TA) 32, and a sustain period (TS) 33. Each subfield 30 of the field 20 is given a weighting by a length (number of sustain discharges) of TS 33, and grayscale is expressed by combinations of lighting ON/OFF of each subfield 30. The method shown in FIG. 3 is one example of "address-, display-period separation method." That is, a discharge of an address operation in TA 32 selects cells to light ON/OFF in SF 30, and the cells are lighted ON/OFF by a discharge of a sustain operation in the next TS 33, so that display is made.

In TR 31, as well as erasing charges formed in the previous TS 33, performed is an operation (reset operation) of rearranging and adjusting charges in the cell for the purpose of support and prepare a discharge in the subsequent TA 32 (address discharge). In TA 32, a discharge (address discharge) for selecting and determining a cell to emit light (target On cell) in SF 30 is performed. In the subsequent TS 33, repetitive discharges are generated between the scan electrode (Y) 12 and the sustain electrode (X) 11, i.e., (Y-X) at the cells selected in the previous TA 32, thereby lighting the cells.

Note that, as a-method of discharge in TA 32, there are a method of forming charges in the target lighting cell (write address method) and a method of erasing charges in target non-lighting cell (erase address method), and the former one is used in the present embodiment. The driving method described above has a standard configuration, and various configurations are possible in detail such as sectioning of respective periods (31, 32, 33).

<Voltage Waveform>

Figures 4A, 4B, 4C, 4D:
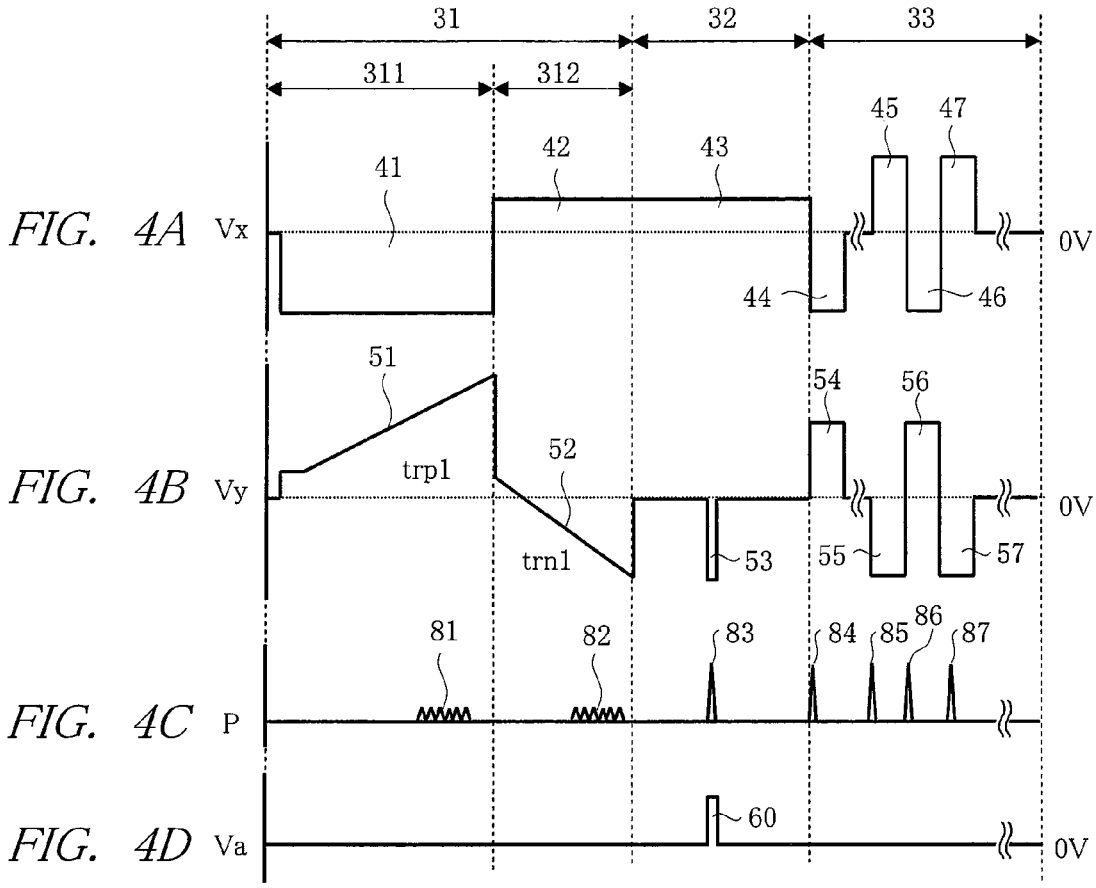
FIGS. 4A-4D are diagrams showing an example of a configuration of voltage waveforms of the PDP device according to the embodiment of the present invention.

Next, in FIGS. 4A-4D, an example of voltage waveforms for driving the PDP 10 will be described. FIGS. 4A, 4B, 4D are voltage waveforms (Vx, Vy, Va) to be applied to the sustain electrode (X) 11, the scan electrode (Y) 12, and the address electrode (A) 15 in TR 31 to TS 33 of SF 30, respectively, and FIG. 4C shows discharge emission (P) at the voltage applications. TR 31 is, if further divided, configured by, for example, a first period 311 and a second period 312.

First, in TR 31, for Vx of 4A and Vy of 4B, a rising slope waveform (trp1) 51 as a waveform for forming charges at all cells is applied at Vy in the first period 311. Further, subsequently, a falling slope waveform (trn1) 52 as a waveform for erasing charges formed at the cells with leaving a required amount is applied at Vy in the second period 312. As a waveform of the sustain electrode 11 corresponding to these waveforms, an X voltage 41 in the first period 311 and an X voltage 42 in the second period 312 are applied for Vx of 4A.

In the next TA 32, for Vx of 4A and for Vy of 4B, as a waveform to generate a discharge (address discharge) for determining cells to display in the row direction, for example, a scan pulse 53 of arbitral N-th row and an X voltage 43 for forming wall charges by this discharge are applied. The scan pulse 53 is applied sequentially per row (scan line) with shifting timing.

And, in TA 32, for Va of 4D, an address pulse 60 is applied along with the scan pulse 53 at the cells to discharge (target On cell), so that a discharge (address discharge) is generated between the scan electrode (Y) 12 and the address electrode (A) 15, i.e., (Y-A), and it is developed to formation of wall charges between the corresponding sustain electrode (X) 11, i.e., (Y-X).

Subsequently, in TS 33, for Vx of 4A and for Vy of 4B, sustain pulses (44 to 47, 54 to 57) are applied. For example, firstly, the sustain pulse 44 having a first negative polarity of Vx and the sustain pulse 54 having a first positive polarity of Vy are applied, and subsequently, the sustain pulse 45 having a second positive polarity of Vx and the sustain pulse 55 having a second negative polarity of Vy are applied, and thereafter, repetitive waveforms are repetitively applied in the same manner for the number of times corresponding to weightings of SF 20 with alternately reversing the polarities.

P of 4C shows emission of cells discharged by the respective voltage waveforms (Vx, Vy, Va). In the first period 311 of TR 31, a small write discharge 81 is generated by the Y rising slope waveform (trp1) 51 of Vy. And, in the second period 312, a weak discharge 82 is also generated by a Y falling slope waveform (trn1) 52. By the waveforms (slope waveforms) whose voltage is gradually changed like the waveforms (51, 52), the discharge becomes small (81, 82) and the amount of emission is also small. In subsequent TA 32, by the sustain pulse described above, respective sustain discharges (84 to 87) are generated.

<Operation Condition and Operation Time>

Based on the basic configuration described in the foregoing, features of the embodiments will be described. First, operation conditions (states) and operation time (T) of the PDP device 100 and the PDP 10 used for control in the present embodiment will be described. The operation time (T) is an approximate calculation of accumulated elapsed time from the start of using the PDP device 100 (including PDP 10). The operation time (T) and operation conditions (states) of the PDP device 100 are managed and comprehended in consideration of changes in characteristics of the protective layer 14 (MgO) etc. which relate to characteristics of the discharge in the PDP 10, particularly. As the operation time (T), in the case of long-period (long-hours), for example, several thousands of hours passing, this leads to a fear of error display arising from changes in discharge characteristics in TR 31 as described above, and thus it is coped by changing the voltage waveform of driving.

In the present embodiment, in the PDP device 100, especially in the control circuit 110, as well as the operation time (T) is measured by a predetermined method to be comprehended, the driving voltage waveform, especially configuration (shape) of the slope waveform of the reset waveform in TR 31 of the voltage waveform (Vy) of the scan electrode 12 is changed according to the operation time (T), so that discharge is controlled being adapted to the change in characteristics of the protective layer 14 (MgO).

As an example of management of the operation time (T), the operation time is comprehended by a predetermined plurality of period sections. To exemplify, sections such as an initial operation period (first period) (t0), a long period (second period) (t1), and a further longer period (third period) (t2) are provided. These sections are determined corresponding to elapsed-time characteristics of the protective layer 14. While the change of voltage waveform is controlled in accordance with three sections in this example, the control may be done in finer manner.

<Change in Voltage Waveform of Scan Electrode>

Next, in FIGS. 5A-5C, an example of the voltage waveform (Vy) applied to the scan pulse per operation time (T) of the PDP device 100 and the PDP 10, which are the feature of the present embodiment will be described. Particularly, parts of the slope waveform in TR 31 are shown in detail. 5A shows a configuration of a voltage waveform (Vy) in the initial operation period (the initial operation period) (t0), 5B shows that in the long-period operation (first long-period operation time) (t1), and 5C shows that in the further longer period than t1 (second long term operation time) (t2).

As a basic configuration, time periods to spend for periods (tr1, tr2, tr3) 501 to 503 having slope waveforms in TR 31 in respective operation time (t0, t1, t2) are configured to be equal, and, reaching potentials (v1 to v3) of the waveform of the rising slope period (51 etc.) and reaching potentials (v4 to v6) of the waveform in the falling slope period (52 etc.) in TR 31 are respectively configured to be equal before and after the change of the voltage waveform (Vy) according to the operation time (T).

Figure 5A:
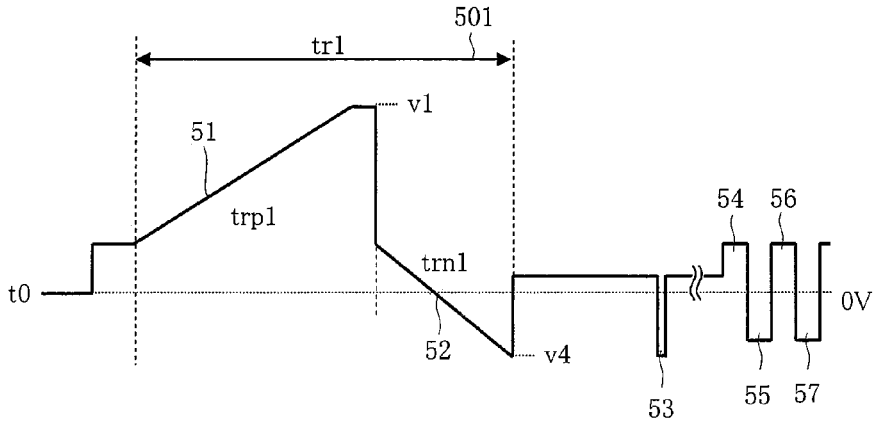
FIGS. 5A-5B are diagrams showing control of changes in slopes of slope waveforms in a reset period corresponding to operation time of the PDP device as an example of voltage waveforms to a scan electrode of the PDP device according to the embodiment of the present invention.

In FIG. 5A, for the voltage waveform (Vy) in the initial operation (t0), the slope (denoted by s1) of the waveform (trp1) 51 in the rising slope period is configured by one type, and a subsequent slope (denoted by s2) of the waveform (trp2)

52 in the falling slope period is also configured by one type. Discharge is performed by the scan pulse 53 in the next TA 32, so that repetitive discharges are performed by sustain pulses (54 to 57) in the subsequent TS 32. No change is made in Vx and Vy in TA 32 and TS 33 as shown in FIG. 4.

Figure 5B:
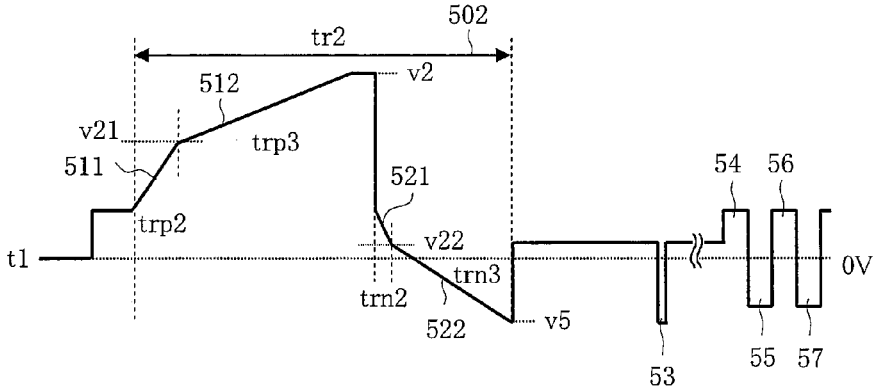

In FIG. 5B, for the voltage waveform (Vy) in the long-period operation time (t1), the reset waveform is changed in the period (tr2) 502 in TR 31, and the waveforms thereafter in TA 32 and TS 33 are same with those described above. As changes in the waveform, the rising slope waveform (trp1) 51 in 5A is configured to be separated as two-step waveforms (trp2, trp3) 511 and 512 in 5B, and, the falling slope waveform (trn1) 52 is also configured to be separated as a two-step waveforms (trn2, trn3) 521 and 522.

The first rising slope waveform (trp2) 511 of the rising slope waveforms (trp2, trp3) in the period (tr2) 502 in TR 31 has its slope (denoted by s11) steeper than the slope (s1) of the rising slope waveform (trp1) 51 in TR 31 of the initial operation (t0). The first rising slope waveform (trp2) 511 is raised to a voltage (v21) which does not generate a discharge associated with the temporal characteristics of MgO being the protective layer 14.

The subsequent second rising slope waveform (trp3) 512 in the rising slope period has its slope (denoted by s12) gentler than the slope (s1) of the rising slope waveform (trp1) 51 in TR 31 of the initial operation (t0).

That is, the waveforms (511, 512) in the rising slope period are waveforms where the voltage is raised steeply in the first period relatively short and the voltage is raised gently in the subsequent second period relatively long so as to reach the predetermined reaching potential (v1). Accordingly, since a continuous weak discharge (81) like shown in FIG. 4C by particularly an effect of the gentle slope waveform (512) is generated, fine generation of charges becomes possible.

In the falling slope period subsequent to the rising slope period in TR 31, first, the first falling slope waveform (trn2) 521 has its slope (denoted by s21) steeper than the slope (s2) of the falling slope waveform (trn1) 52 in TR 31 of the initial operation (t0), so as to fall to a voltage (v22) which does not generate a discharge. The subsequent second falling slope waveform (trn3) 522 has its slope (denoted by s22) gentler than the slope (s2) of the second falling slope waveform (trn1) 52 in TR 31 of the initial operation (t0). Accordingly, fine generation of charges similarly becomes possible. In this manner, by the fine reset operation corresponding to changes in characteristics of the protective layer 14 (MgO), error display arising from TR 31 can be prevented.

Figure 5C:
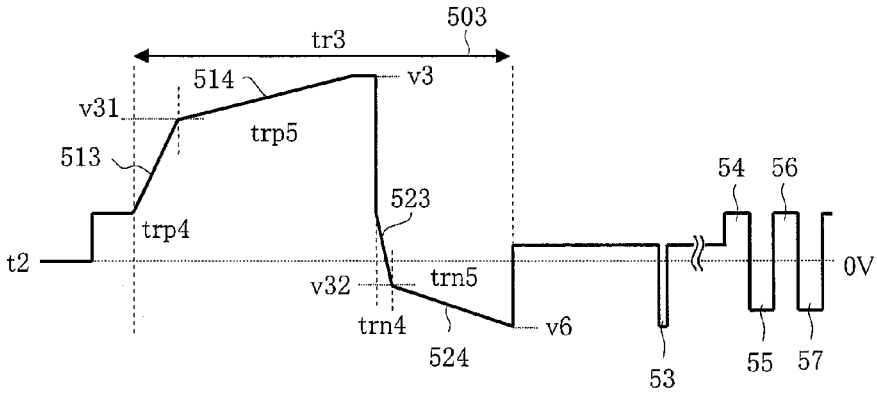

Further, in FIG. 5C, for the voltage waveform (Vy) in the operation time (t2) after a long-period operation longer than the operation time (t1), as well as each slope waveform is configured in two steps, the slopes thereof are changed to have a steeper change. Same with the case of the operation time (t1), operations and waveforms in TA 32 and TS 33 are same with those described above.

In the period (tr3) 503 in TR 31 of the operation time (t2), the first rising slope waveform (trp4) 513 in the rising slope period has its slope (denoted by s13) steeper or same compared with the slope (s11) of the first rising slope waveform (trp2) 511 in the period (tr2) 502 in the operation period (tr1). And, the reaching potential (v31) of the first rising slope waveform (trp4) 513 is raised more than the reaching potential (v21) of the first rising slope waveform (trp2) 511 described above, and raised to a potential which does not generate a discharge.

The subsequent second rising slope waveform (trp5) in the rising slope period has its slope (denoted by s14) gentler than the slope (s12) of the second rising slope waveform (trp3) 512 in the period (tr2) 502 of the operation time (t1). Accordingly, fine generation of charges is similarly become possible.

The subsequent first falling slope waveform (trn4) 523 in the falling slope period in the period (tr3) 503 has its slope (denoted by s23) steeper or same compared with the slope (s21) of the first falling slope waveform (trn2) 521 in the period (tr2) 502 of the operation time (t1) described above. And, the reaching potential (v32) of the first falling slope waveform (trn4) 523 is fallen to the reaching potential (v22) of the first falling slope waveform (trn2) 521 described above, and fallen to a potential which does not generate a discharge.

The subsequent second falling slope waveform (trn5) 524 in the falling slope period has its slope (denoted by s24) gentler than the slope (s22) of the second falling slope waveform (trn3) 522 in the period (tr2) 502 of the operation time (t1) described above. Accordingly, a fine generation of charges becomes possible, and error display arising from TR 31 can be prevented.

Other than the configurations described above, for example, the voltage waveform (t1) of the initial operation can have a configuration to be a voltage waveform configured by two-step slopes as shown in 5B. Also in this case, the voltage waveform in the operation time (t1) after the change corresponding to the operation time (T) has a configuration to which a voltage waveform configured by slopes having two steps and steeper slopes as shown in 5C is adapted. Alternatively, a configuration may have the waveform changed to have three-step slopes. These configurations also can avoid error display arising from TR 31, as the object herein.

Further, while the configurations have been made such that the time period to spend in the period of the waveform having a slope and the reaching potential in TR 31 shown in FIGS. 5A-5C etc. are constant before and after the change according to the operation conditions and operation time (T), it is not limited to these, and it may have a configuration where they are changed to some extent in accordance with the operation conditions.

<Control Circuit>

Figure 6:
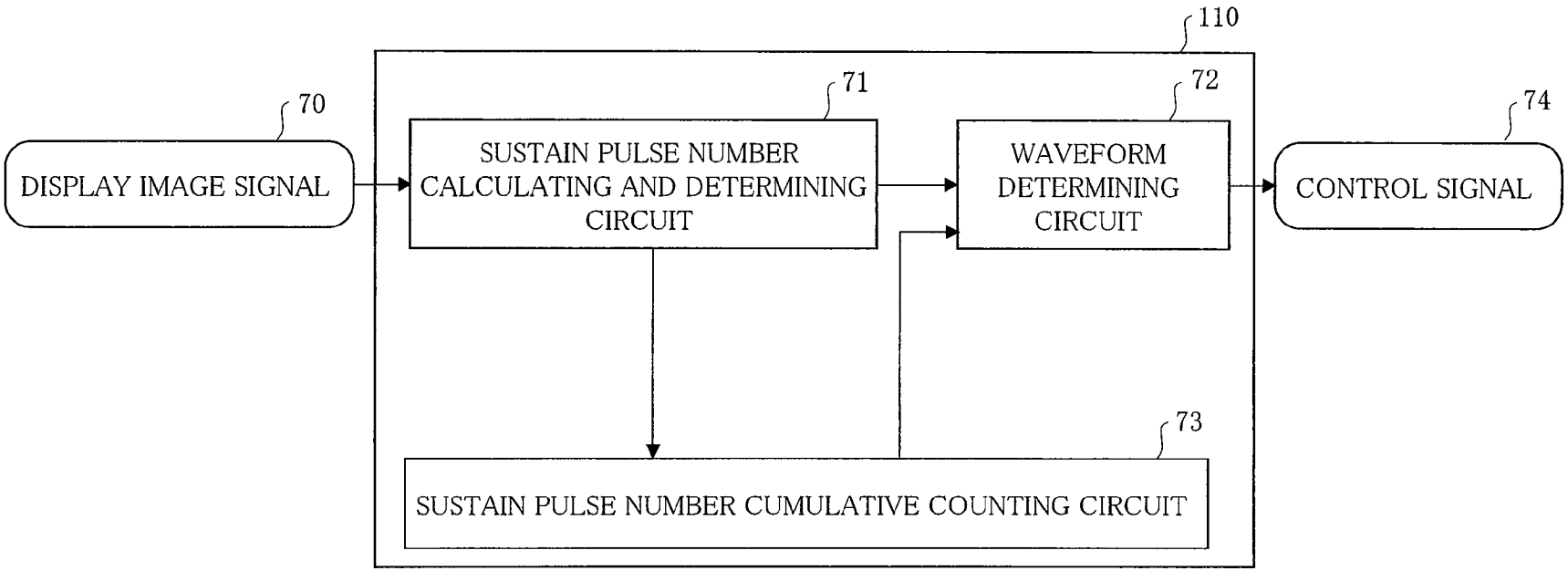
FIG. 6 is a diagram showing a block configuration of a control circuit of the PDP device according to a first embodiment of the present invention.

Next, in FIG. 6, a block configuration of the control circuit 110 for comprehending the operation time (T) of the PDP device 100 and the PDP 10 in the PDP device 100 of the first embodiment will be described. The control circuit 110 has a configuration having and sustain pulse number calculating and determining circuit 71, a waveform determining circuit 72, and a sustain pulse number cumulative counting circuit 73.

In the control circuit 110, basically, according to a display image signal 70 inputted, the sustain pulse number calculating and determining circuit 71 and the waveform determining circuit 72 generate and output a control signal 74 in accordance with drive control of the field 20 and SF 30. The sustain pulse number calculating and determining circuit 71 calculates and determines a waveform to output corresponding to the number of sustain pulses (number of repetitive discharges) of SF 30. The waveform determining circuit 72 selects and determines a waveform to output corresponding to the number of sustain pulses. The control signal 74 is, for example, a control signal of outputting a selected waveform for controlling the Y driving circuit 102 and a control signal of switching, and based on the control signal 74 (selected waveform), the Y driving circuit 102 generates and applies the voltage waveform (Vy) to the scan electrode 12.

In the first embodiment, particularly, the configuration in the control circuit has the sustain pulse cumulative counting circuit 73 provided thereto. To output appropriate slopes per the operation time (T) for the rising slope waveform in TR 31 and the like, the cumulative number of sustain pulses (total number of discharges) is monitored and calculated in the control circuit 110, and the slopes of the rising slope waveform in TR 31 and the like are changed based on the value. More specifically, the number of sustain pulses is monitored based on the sustain pulse number calculating and determining circuit 71, and the value is cumulatively counted by the sustain pulse number cumulative counting circuit 74, so that a voltage waveform to be outputted is switched and select-determined by the waveform selecting circuit 72 based on the value of the cumulative number of sustain pulses. To comprehend the operation time (T), the cumulative number of sustain pulses is corresponded to the periods (t0 to t2). Note that, the functions of these circuits may be achieved by other means.

<Scan Driving Circuit (1)>

Figure 7:
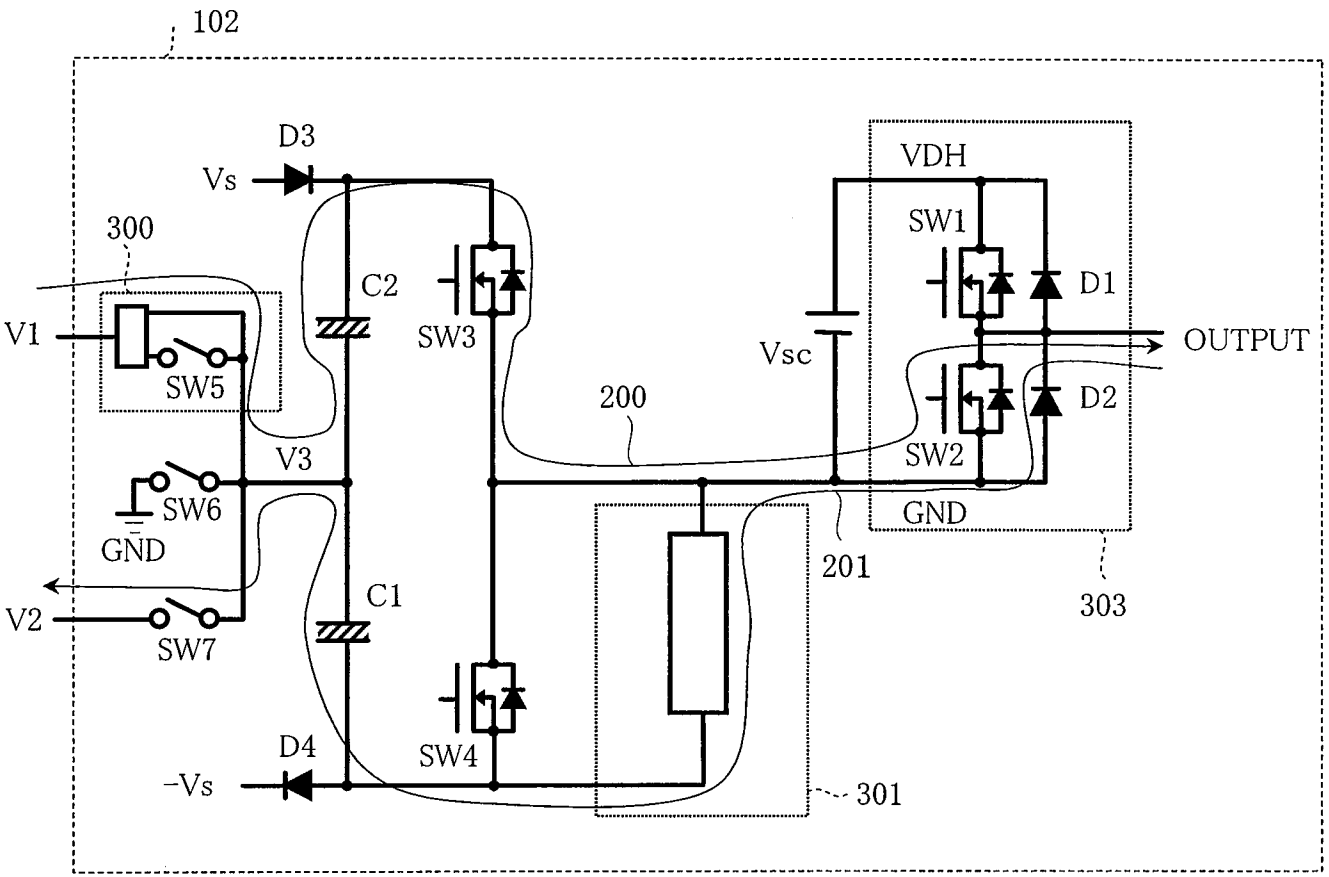
FIG. 7 is a diagram showing a schematic configuration of a scan driving circuit of the PDP device according to the first embodiment of the present invention.

Next, in FIG. 7 and FIG. 8, a configuration of the Y driving circuit 102 for driving the scan electrode 12 of the first embodiment will be described. In the Y driving circuit 102 in FIG. 7, a rising slope waveform output circuit 300, a falling slope waveform output circuit 301, a scan driver 303 and the like are provided as circuit blocks. Current paths 200 and 201 show paths corresponding to switching of switches in the circuit, where the current path 200 shows an output path of the rising slope waveform, and the current path 201 shows an output path of the falling slope waveform.

In the Y driving circuit 102, a power voltage V1, a power voltage V2, and the ground (GND) are switched by switches SW5, SW6, and SW7, thereby determining a power source side voltage V3 of the present circuit. A voltage of (V3−Vs) and a voltage of (V3+Vs) are generated by interposing capacitors C1, C2 from the power source side voltage V3, and the voltage (V3−Vs) is outputted to the scan driver 303 by short-circuiting a switch SW4 and the voltage (V3+Vs) is outputted to the scan driver 303 by short-circuiting a switch SW3. Vs and −Vs are sustain voltages.

The scan driver 303 is a circuit for applying a scan pulse to one scan electrode 12, and a circuit part for driving one bit (one line of scan electrode 12) of the integrated circuit is shown. In TA 32, a scan pulse voltage Vsc is applied to the scan electrode 12 by short-circuiting the switch SW1, and the switch SW2 is short-circuited in other periods, so that the voltage applied to the scan driver 303 is outputted to the scan electrode 12 as it is.

A circuit which outputs a slope waveform of reset waveform in TR 31 has the rising slope waveform output circuit 300 which is operated by opening SW5, and the falling slope waveform output circuit 301 which is operated by short-circuiting an internal switch; and the currents are controlled by respective slope waveform output circuits (300, 301), thereby changing the slope of the slope waveform.

Figure 8:
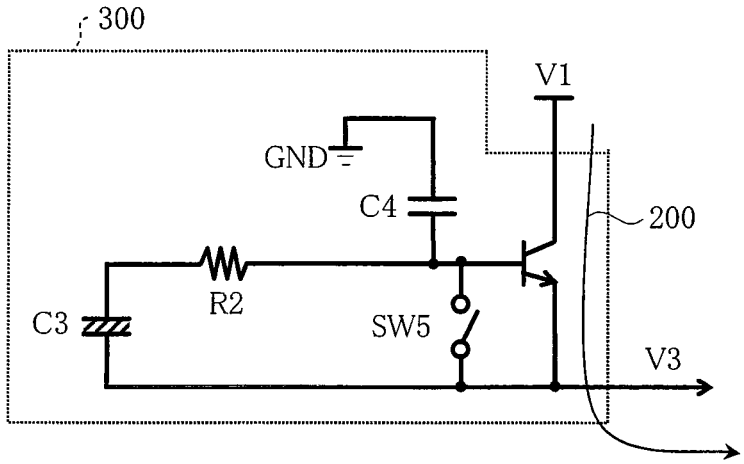
FIG. 8 is a diagram showing a schematic configuration of a rising-slope waveform output circuit in the scan driving circuit of the PDP device according to the first embodiment of the present invention.

The rising slope waveform (trp1) 51 in TR 31 as shown in FIG. 4 is outputted through the current path 200 by opening the switch SW5 of the rising slope waveform output circuit 300 in FIG. 8, and the Y falling slope waveform (trn1) 52 in the same TR 31 is outputted through the current path 201 by short-circuiting an internal switch of the falling slope waveform output circuit 301.

<Waveform of Scan Driving Circuit (1)>

Figures 9A, 9B, 9C:
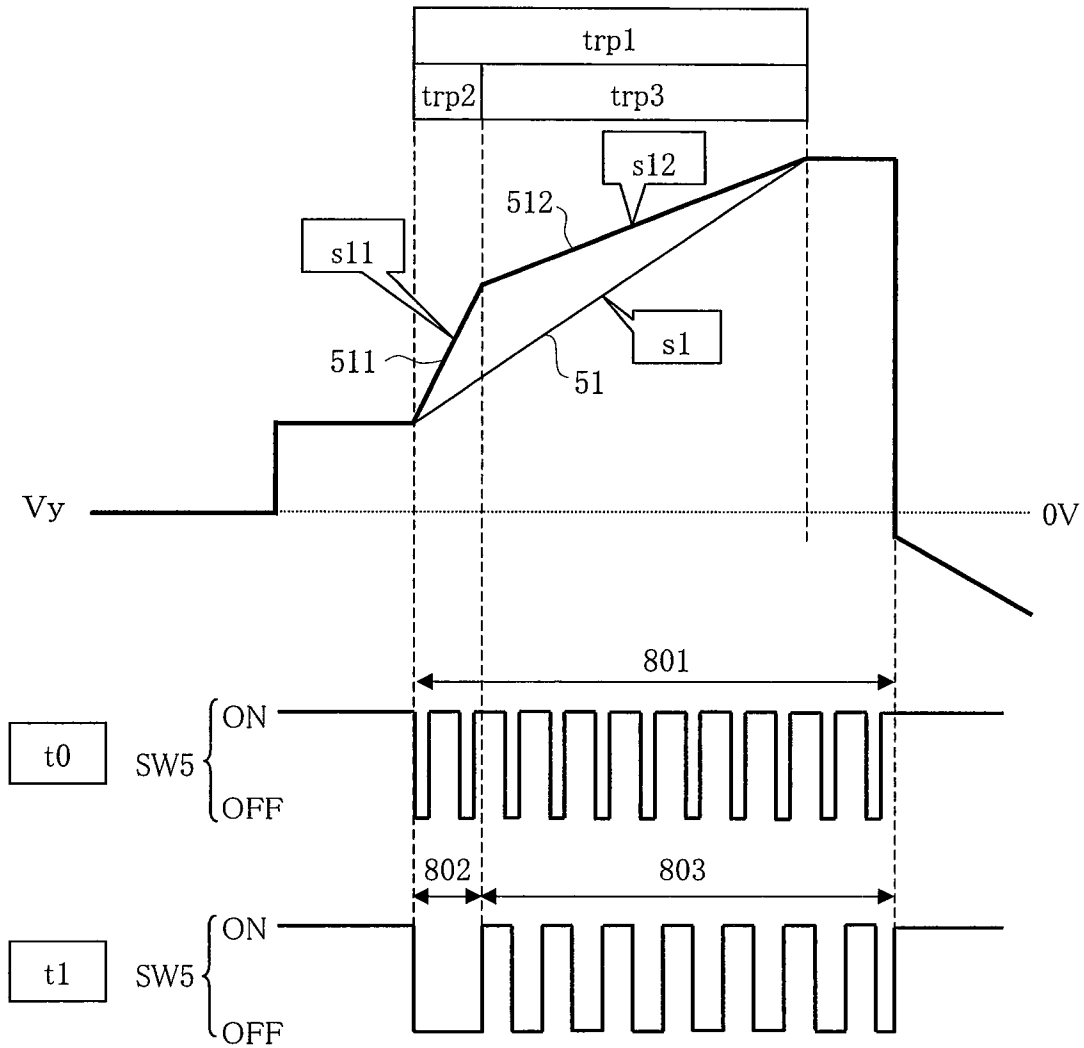
FIG. 9 is a diagram showing control of an output of a rising-slope waveform in the scan driving circuit shown in FIG. 7 and FIG. 8 of the PDP device according to the first embodiment of the present invention.

Next, in FIGS. 9A-9C, the voltage waveforms for driving by the Y driving circuit 102 of FIG. 7 and FIG. 8 will be described. FIG. 9A shows waveforms of Vy before and after the change at the time (t0, t1) in the rising slope period in TR 31 similar to FIGS. 5A and 5B, where the waveforms are overlapped. FIGS. 9B and 9C show waveforms at ON/OFF of the switch SW5 of the rising slope waveform output circuit 300 in FIG. 8 of the time (t0, t1). A relationship of the slopes of the waveforms (trp1 to trp3) of the respective rising slopes is, as described above, s12<s1<s11.

In the rising slope waveform output circuit 300 in FIG. 8, the switch SW5 is opened and a current flows in a base of a transistor and through a collector and an emitter so that a rising slope waveform is outputted, where the slope of the rising slope waveform is changed according to the magnitude of the current flowing into the base of the transistor. ON/OFF of the switch SW5 is intermittently performed, so that the slope is controlled by changing the ON/OFF periods (the technique described in Patent Document 2 described above is used).

In FIG. 9A-9C, in the case where the slope (s1) of the rising slope waveform (trp1) before the change of 9A is outputted, output is made by controlling the switch SW5 intermittently as a waveform in a period 801 of the operation time (t0) of 9B, and, in the case where the slope (s11) of the first rising slope waveform (trp2) 511 after the change of 9A is outputted, the switch SW5 is controlled to be open (OFF) as a waveform in a period 802 of the operation time (t1) of 9C, and subsequently, in the case where the slope (s12) of the second rising slope waveform (trp3) 512 is outputted, it is possible by controlling the OFF period of the switch SW5 to be wider than the control of the switch SW5 for outputting the rising slope waveform (trp1) 51 of 9B as a waveform in a period 803 subsequent to the operation time (t1) of 9C. By controlling with using floating of the switch (SW5) in this manner, the slope of the slope waveform can be changed easily.

<Discharge in Reset Period (1)>

Figures 10A, 10B, 10C:
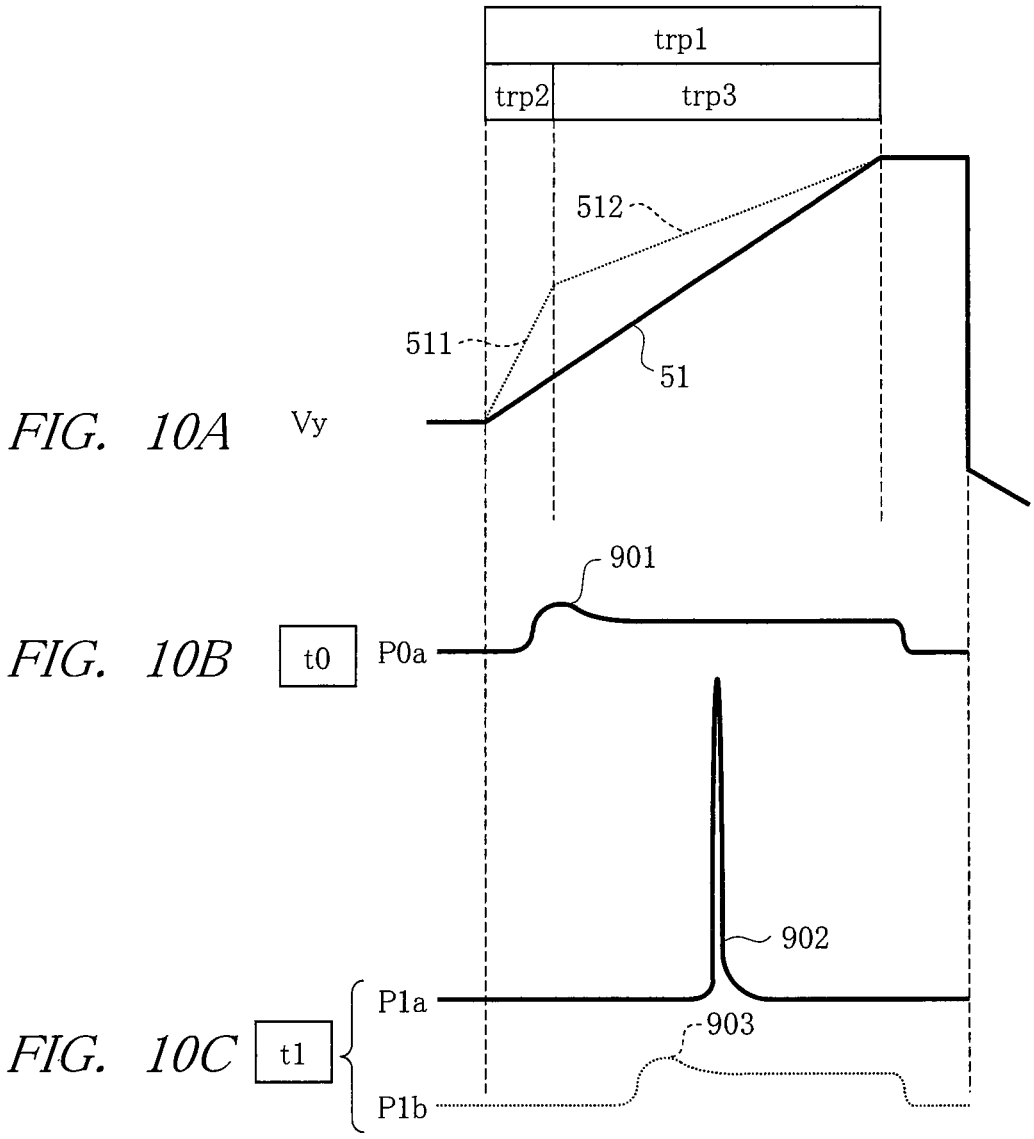
FIG. 10A-10C are diagrams showing a state of a discharge by a slope of the rising-slope waveform in accordance with changes in characteristics of a protective layer and operation time of a voltage waveform of the scan electrode of the reset period of the PDP device according to the first embodiment of the present invention.

Next, in FIGS. 10A-10C, a discharge in TR 31 generated according to a change in the slope of the rising slope waveform along with changes in characteristics of the protective layer 14 (MgO deterioration) and the operation time (T) of the voltage waveform (Vy) in TR 31 will be described. FIG. 10A shows a part of the voltage waveform (Vy) of the operation time (t0, t1) same as described above, where the solid line portion is a waveform of to, and the dotted line portion is a waveform of t1. FIG. 10B shows a discharge (P0*a*) by the rising slope waveform (trp1) 51 of t0, and FIG. 10C shows a discharge (P1*a*) by the rising slope waveform (trp1) 51 of t1 of the conventional technique by the upper solid line, and a discharge (P1*b*) by the first rising slope waveform (trp2) 511 and the second rising slope waveform (trp3) 512 of t1 of the present invention by the lower dotted line, respectively.

In the case of the slope (s1) of the rising slope waveform (trp1) 51 in the initial operation (t0), as P0*a* of 10B, a continuous weak discharge 901 can be performed stably. However, in the case of the slope (s1) of the rising slope waveform (trp1) 51 in the operation time (t1) after the conventional long-period operation, as P1*a* of 10C, a strong discharge 902 is generated due to a discharge delay by elapsed-time characteristics of the protective layer 14 (MgO), which is not preferable.

On the other hand, by adapting the feature of the present embodiment to P1*a*, as P1*b* of 10C, first, a discharge is not performed at the steep slope (s11) of the first rising slope waveform (trp2) 511 in t1 because of the elapsed-time characteristics of the protective layer 14. Next, at the slope (s12) of the second rising slope waveform (trp3) 512, it is gentler than the slope (s11) of the precious waveform (trp2) 511, and thus the continuous weak discharge 903 can be performed stably without generating the strong discharge 902.

While discharge characteristics in the control of changes in voltage waveform, particularly, those in the long-period operation time (t1) after the first change are shown in FIG. 10A-10C, as well as after the long-period operation time (t2) further longer than t1 as in FIG. 5C, control is similarly made so as to output a slope waveform in accordance with the elapsed-time characteristics of the protective layer 14 and the operation time (T) and a slope waveform having a plurality of steps according to a predetermined period sections. In this manner, a stable continuous weak discharge adapted to the elapsed-time characteristics of the protective layer can be performed, thereby preventing error display arising from the rising slope waveform in TR 31.

<Scan Driving Circuit (2)>

Figure 11:
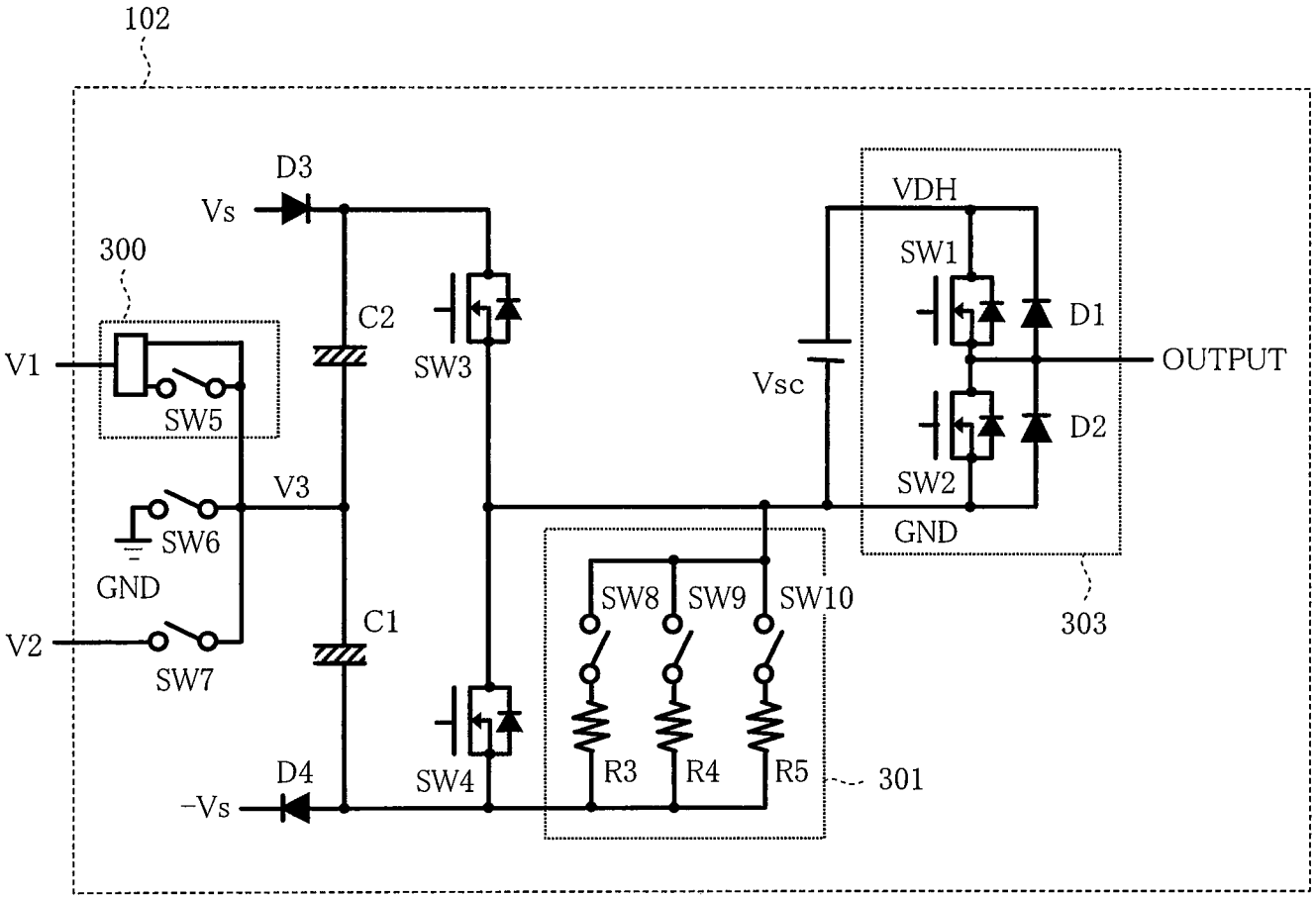
FIG. 11 is a diagram showing a configuration of the scan driving circuit including a specific configuration of a falling-slope waveform output circuit shown in FIG. 7 of the PDP device according to the first embodiment of the present invention.

Next, in FIG. 11, for the Y driving circuit 102 of the present embodiment, there is shown a configuration example of the Y driving circuit 102 where a specific configuration of the falling slope waveform output circuit 301 is added. In the falling slope waveform output circuit 301, three resistors R3, R4, R5 are connected in parallel, and resistance values thereof are changed by switching switches SW8, SW9, SW10.

In an output of a falling slope waveform in TR 31, the amount of the flowing current is changed by the change in the resistance value so as to control the slope of the waveform. Generally, the larger the resistance value is, the gentler the slope is, and the smaller the resistance value is, the steeper the slope is.

<Waveform of Scan Driving Circuit (2)>

Figures 12A, 12B, 12C:
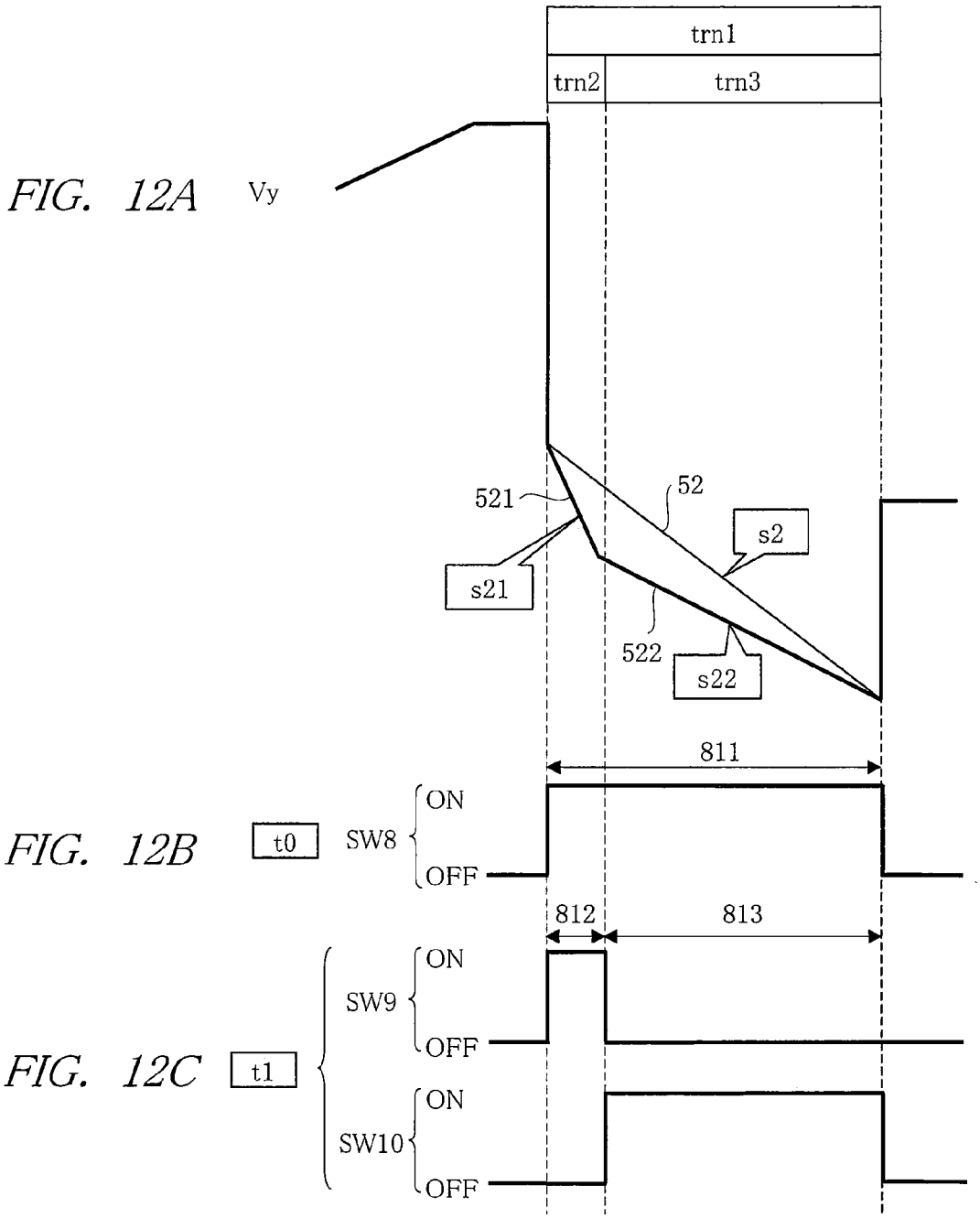
FIGS. 12A-12C are diagrams showing control of an output of a falling-slope waveform in the scan driving circuit shown in FIG. 10 of the PDP device according to the first embodiment of the present invention.

Next, in FIGS. 12A-12C, a method of controlling the falling slope waveform in the configuration example of the Y driving circuit 102 in FIG. 11 will be described. FIG. 12A shows, similarly to FIGS. 5A and 5B, waveforms before and after the change in the operation time (t0, t1) of the falling slope waveform in TR 31 of Vy, where the waveforms are overlapped. FIGS. 12B and 12C show waveforms of ON/OFF of the switches SW8 to SW10 of the falling slope waveform output circuit 301 in FIG. 11 in the operation time (t0, t1). A relationship of the respective falling slope waveforms (trn1 to trn3) is, as described above, s22<s2<s21.

In the falling slope waveform output circuit 301, in the operation time (t0), only the switch SW8 is short-circuited (ON) and a falling slope period 811 has the slope (s2) of the falling slope waveform (trn1) 52 by the resistor R3 as shown in 12B. A waveform (trn2) 521 in a first-step falling period 812 in the long-period operation time (t1) has, as shown in 12C, the slope (s21) of the first falling slope waveform (trn2) 521 by the resistor R4 by short-circuiting only the switch SW9 in the period 812. A subsequent waveform (trn3) 522 in a second-step falling period 813 can obtain the slope (s22) of the second falling slope waveform (trn3) 522 by the resistor R5 by short-circuiting only the switch SW10 in the period 813. In this manner, by controlling the current by a resistance value, various slopes can be outputted simply.

The Y driving circuit 102 and the method thereof shown in FIG. 7 to FIGS. 12A-12C are an example of a circuit, a method, and a configuration of electrodes to use for controlling changes of slopes of a slope waveform in TR 31 in accordance with the operation time (T), which are the features herein, and they are not limited to this example.

<Discharge in Reset Period (2)>

Next, a discharge in TR 31 generated in accordance with a change in a slope of a falling slope waveform will be described. Control of a falling slope waveform is substantially same with the control of rising slope waveform in FIG. 10 described above. In t0, as similar to P0*a* in 10A described above, a continuous weak discharge is generated by the slope (s2) of the falling slope waveform (trn1) 52. And, in t1, as similar to P1*b* in 10C described above, a discharge is not performed at the steep slope (s21) of the first falling slope waveform (trn2) 521 due to the elapsed-time characteristics of the protective layer 14. Next, at the slope (s22) of the second falling slope waveform (trn3) 522, it is gentler than the slope (s21) of the previous waveform (trn2) 521, so that a continuous weak discharge can be performed stably without generating a strong discharge. In this manner, error display arising from the falling slope waveform in TR 31 can be prevented.

(Second Embodiment)

Next, with reference to FIG. 13, a second embodiment of the present invention will be described. The second embodiment has same basic configuration as that of the first embodiment, and has different method and configuration for monitoring operation conditions and operation time (T) for changing (switching) slopes of a slope waveform in TR 31. In the second embodiment, as an operation condition to use in control for driving, comprehension of sustain power (total power consumption) is used in the control circuit 110, so that the slope waveform in TR 13 is controlled to drive in accordance with the periods (t0 to t2) similar to the first embodiment.

<Control Circuit (2)>

Figure 13:
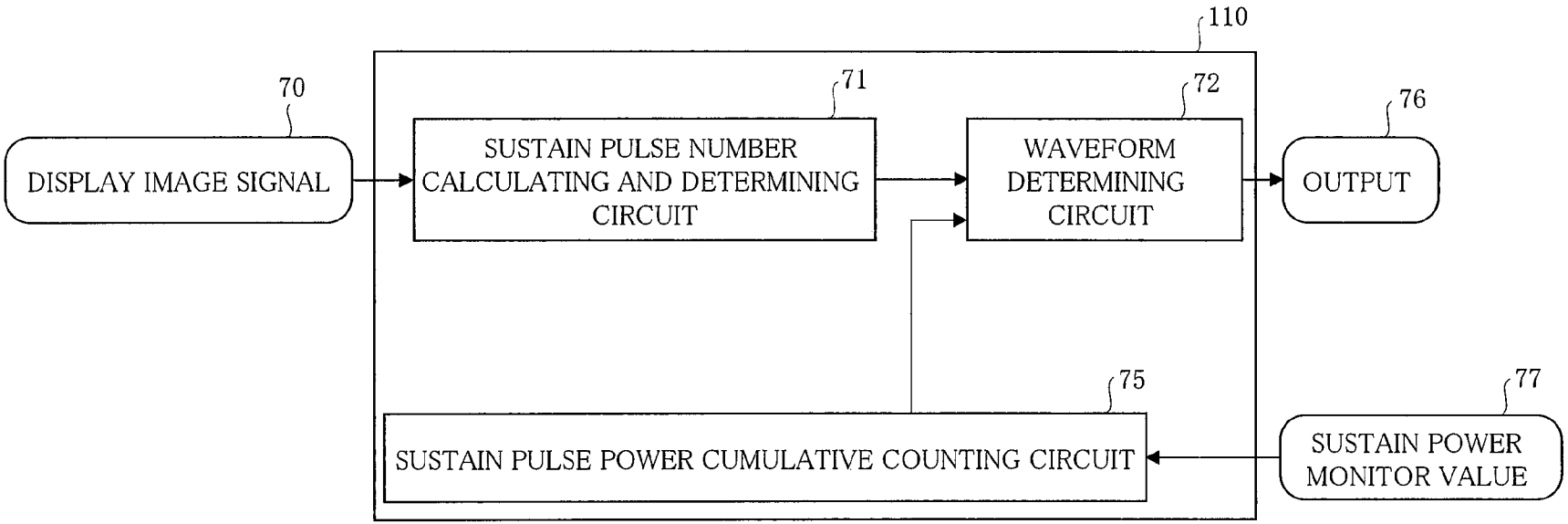
FIG. 13 is a diagram showing a block configuration of a control circuit of a PDP device according to a second embodiment of the present invention.

In FIG. 13, a configuration of the control circuit 110 according to the second invention will be described. The control circuit 110 has a different part from the first embodiment that a sustain power cumulative counting circuit 75 is provided, so that a sustain power cumulative value (estimated from the start of using the PDP device 100) is comprehended by an input of a sustain power monitor value 77 and an output 76 is determined.

In the control circuit 110, the number of sustain pulses is calculated by the sustain number calculating and determining circuit 71 according to the display image signal 70, so that a waveform is selected and determined by the waveform determining circuit 72, and a control signal of the control circuit 110 is the output 76. The PDP device 100 monitors power required for sustain power, that is, a discharge in the sustain operation in TS 33. The monitoring of sustain power is performed by, for example, the X driving circuit 101 and the Y driving circuit 102, and a sustain power monitoring value 77 obtained therein is inputted to the control circuit 110.

In the control circuit 110, the sustain power is cumulatively counted by the sustain power cumulative counting circuit 75 using the input of the sustain power monitoring value 77, and based on the value (cumulative sustain power value), the waveform is switched by the waveform selecting circuit 72 to make the output 76. In accordance with the sustain power value, as same as the first embodiment, the slope of the slope waveform in TR 31 is changed, thereby obtaining a stable continuous weak discharge and preventing error display arising from TR 31.

(Third Embodiment)

Next, with reference to FIG. 14, a third embodiment of the present invention will be described. In the third embodiment, as compared with the first embodiment, the basic configuration is same, and a method and configuration of monitoring operation conditions and operation time (T) for changing (switching) the slope of a slope waveform in TR 31 are different. In the third embodiment, as an operation condition used in drive control, comprehension of conducting time (energizing time) is used so that a slope waveform in TR 13 is controlled for driving corresponding to the periods (t0 to t2) similarly to the first embodiment.

<Control Circuit (3)>

Figure 14:
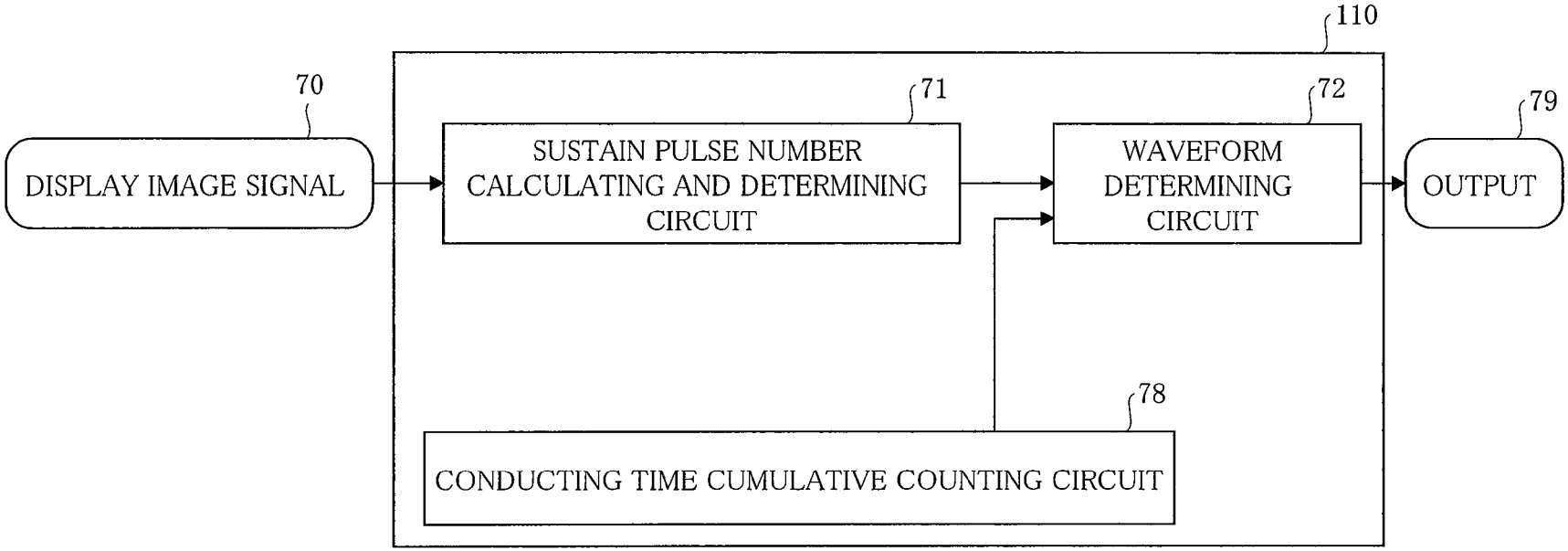
FIG. 14 is a diagram showing a block configuration of a control circuit of a PDP device according to a third embodiment of the present invention.

In FIG. 14, a configuration of the control circuit 110 according to the third embodiment will be described. The control circuit 110 has, as a different part from the first embodiment, a conducting time cumulative counting circuit 78 is provided, and total conducting time (approximately calculated from the start of using PDP 100) is comprehended, so that an output 79 is determined.

In the control circuit 110, a number of sustain pulses is calculated by the sustain pulse number calculating and determining circuit 71 according to the display image signal 70, and a waveform is selected and determined by the waveform determining circuit 72, so that a control signal of the control circuit 110 is an output 79. The control circuit 110 monitors conducting time. This monitoring of conducting time is done by, for example, simply monitoring elapsed time by a clock circuit and the like. A monitoring value is cumulatively counted by the conducting time cumulative counting circuit 78, and based on the value, the waveform selecting circuit 72 switches the waveform to make the output 79. Corresponding to the conducting time, as same as the first embodiment, the slope of the slope waveform in TR 31 is changed, thereby obtaining a stable continuous weak discharge and preventing error display arising from TR 31.

(Fourth Embodiment)

Figure 15:
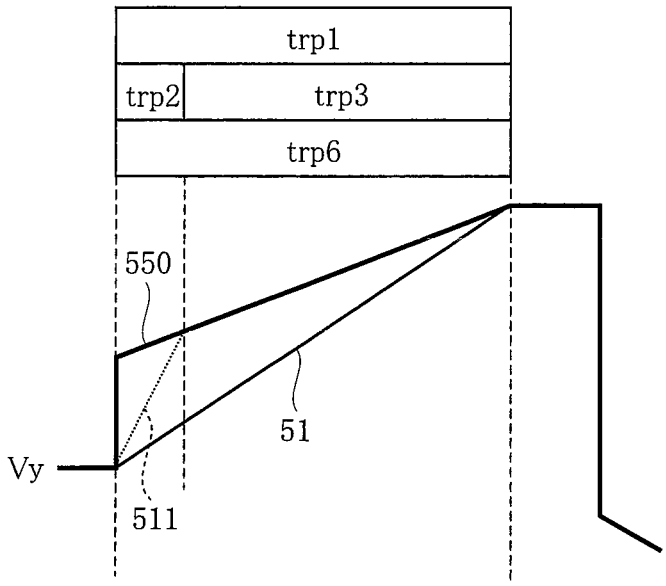
FIG. 15 is a diagram showing a configuration example of another control of voltage waveform of a PDP device according to an embodiment of the present invention.

Next, with reference to FIG. 15, a fourth embodiment will be described. The fourth embodiment is an example of another control of changes in the slope of the voltage waveform (Vy) of the Y driving circuit 102. In FIG. 15, as an example, waveforms before and after a change in the operation time (t0, t1) of the rising slope waveform in TR 31 of Vy, which is similar to FIGS. 5A and 5B, are shown, where the waveforms are overlapped. The respective rising slope waveforms (trp1 to trp3) are same with those described above. A waveform (trp6) 550 in the rising slope period shown by the solid line is made to have a configuration of one waveform having its slope rising substantially perpendicular in the part of the rising slope waveform (trp2) 511 in the first step period, so that the slope becomes the same with the slope (s12) of the rising slope waveform (trp3) 512 in the subsequent second step period. The present configuration example can be taken such that it is not a configuration having a stepwise slope waveform, but a configuration where the slope (s12) of the rising slope waveform (trp6) 550 in t1 is changed to be gentler than the slope (s1) of the rising slope waveform (trp1) 51 in t0. Also in such a configuration, the situation of discharge in TR 31 is substantially same with that in FIGS. 10A-10C described above, and a continuous weak discharge can be performed stably without generating a strong discharge.

As described in the foregoing, according to each of the respective embodiments, the reset waveform in TR 31 is optimized corresponding to the operation conditions and operation time (T) of the PDP device 100 and the PDP 10 so that a stable continuous weak discharge is obtained in TR 31, thereby preventing error display and improving display quality.

While the drive control in the embodiments described above has had a configuration where both the rising slope waveform and the falling slope waveform in TR 31 have the slopes thereof changed corresponding to the operation conditions and operation time (T), it is not limited to this and the configuration of control can be such that the slope of the waveform in either the rising slope period or the falling slope period is changed.

In addition, the voltage waveform in TR 31 is not limited to the configuration of two-step slope, and it can be a slope having three or more steps.

In the foregoing, the invention made by the inventors of the present invention has been concretely described based on the embodiments. However, it is needless to say that the present invention is not limited to the foregoing embodiments and various modifications and alterations can be made within the scope of the present invention.

INDUSTRIAL APPLICABILITY

The present invention is applicable to a technique of a PDP device.

The invention claimed is:

1. A plasma display device comprising:

a plasma display panel having at a front substrate side: pluralities of scan electrodes and sustain electrodes extending in a first direction; a first dielectric layer covering the scan and sustain electrodes; and a protective layer covering the first dielectric layer, and having at a rear substrate side: a plurality of address electrodes extending in a second direction intersecting the first direction; a second dielectric layer covering the address electrodes; barrier ribs at both sides of the address electrode; and a phosphor between the barrier ribs, wherein the front substrate side and the rear substrate side are combined, so that cells are configured in a matrix corresponding to intersections of the scan electrodes and sustain electrodes and the address electrodes;

driving circuits which apply a voltage waveform for driving to the respective pluralities of scan electrodes, sustain electrodes, and address electrodes; and a control circuit which controls the voltage waveform, wherein:

in drive control of a display area of the display panel, there are provided: a reset period for generating a discharge for forming and adjusting charges to the cell; an address period for performing a discharge for selecting a target On cell; and a sustain period for performing a discharge for display by applying a sustain pulse at the selected cell, a first voltage waveform having a rising slope and a second voltage waveform having a falling slope are applied to the electrodes of the plasma display panel in the reset period, a slope of one of the first voltage waveform and the second voltage waveform from a start of application of the one voltage waveform to a first predetermined timing is a first slope, and a slope of the one voltage waveform from the first predetermined timing to an end of application of the one voltage waveform is a second slope, and the second slope is steeper while an accumulated operation time from a start of using the plasma display panel of the plasma display device is from zero to a first time than after the first time.

2. The plasma display device according to claim 1, wherein:

regardless of a length of the accumulated operation time, attained voltage values of the voltage waveforms are equal and application periods of the voltage waveform are equal, and the first slope is steeper while the accumulated operation time is from zero to the first time than after the first time.

3. The plasma display device according to claim 2, wherein:

the first slope and the second slope are equal between the accumulated operation time of zero to the first time, and the first slope and the second slope are different after the first time.

4. The plasma display device according to claim 3, wherein:

the first slope after the first time is steeper than that from zero to the first time, and the second slope after the first time is gentler than that between the elapsed operation time of zero to the first time.

5. The plasma display device according to claim 4, wherein a period of applying a slope waveform having the second slope is relatively longer than a period of applying a slope waveform having the first slope.

6. The plasma display device according to claim 1, wherein the control circuit detects a cumulative count of a number of the sustain pulses in the sustain period and the accumulated operation time of the plasma display device has a value corresponding to a detected value of the cumulative count.

7. The plasma display device according to claim 6, wherein the control circuit detects a cumulative count of consumption power in the sustain period and the accumulated operation time of the plasma display device has a value corresponding to a detected value of the consumption power.

8. The plasma display device according to claim 6, wherein the control circuit detect a cumulative count of conducting time to the plasma display panel, and the accumulated operation time has a value corresponding to a detected value of the cumulative count.

9. A method of driving a plasma display device comprising a plasma display panel that has at a front substrate side: pluralities of scan electrodes and sustain electrodes extending in a first direction; a first dielectric layer covering the scan and sustain electrodes; and a protective layer covering the first dielectric layer, and has at a rear substrate side: a plurality of address electrodes extending in a second direction intersecting the first direction; a second dielectric layer covering the address electrodes; barrier ribs at both sides of the address electrode; and a phosphor between the barrier ribs, wherein the front substrate side and the rear substrate side are combined, and cells are configured in a matrix corresponding to intersections of the scan electrodes and sustain electrodes and the address electrodes, comprising steps:

in drive control of a display area of the display panel, providing: a reset period for generating a discharge for forming and adjusting charges to the cell; an address period for performing a discharge for selecting a target On cell; and a sustain period for performing a discharge for display by applying a sustain pulse at the selected cell, and applying a first voltage waveform having a rising and/or falling slope is applied to the electrodes of the plasma display panel in the reset period, wherein:

a slope of one of the first voltage waveform and the second voltage waveform from a start of application of the one voltage waveform to a first predetermined timing is a first slope, and a slope of the one voltage waveform from the first predetermined timing to an end of application of the one voltage waveform is a second slope, and the second slope is steeper when accumulated operation time from a start of using the plasma display panel of the plasma display device is is from zero to a first time, than after the first time.

10. The method of driving the plasma display panel according to claim 9, wherein the first slope and the second slope are the same at the first time when the accumulated operation time is from zero to the first time, and the second slope is gentler than the first slope after the first time.

11. The method of driving a plasma display device according to claim 9, wherein:

regardless of a length of the accumulated operation time, attained voltage values of the voltage waveforms are equal and application periods of the voltage waveforms are equal, and the first slope after the first time is steeper than the first slope when the accumulated operation time is from zero to the first time.

* * * * *